US005158864A

United States Patent [19]

Matejec et al.

[11] Patent Number: 5,158,864

[45] Date of Patent: Oct. 27, 1992

[54] COLOR PHOTOGRAPHIC MATERIAL

[75] Inventors: Reinhart Matejec, Leverkusen; Erich Wolff, Solingen; Heinrich Odenwälder, Leverkusen; Hans Öhlschläger, Bergisch Gladbach, all of Fed. Rep. of Germany

[73] Assignee: Agfa Gevaert Aktiengesellschaft, Leverkusen, Fed. Rep. of Germany

[21] Appl. No.: 586,276

[22] Filed: Sep. 21, 1990

Related U.S. Application Data

[63] Continuation-in-part of Ser. No. 454,748, Dec. 21, 1989, abandoned.

[30] Foreign Application Priority Data

Dec. 22, 1989 [EP] European Pat. Off. ..... 89123723
Dec. 22, 1989 [EP] European Pat. Off. ..... 89123723.2
Dec. 29, 1989 [JP] Japan ..... 1-345013

[51] Int. Cl.[5] ..... G03C 1/46

[52] U.S. Cl. ..... 430/505; 430/546; 430/543; 430/549; 430/551; 430/552; 430/556; 430/554; 430/558; 430/544

[58] Field of Search ..... 430/546, 543, 549, 551, 430/552, 556, 554, 558, 544, 505

[56] References Cited

U.S. PATENT DOCUMENTS 2,296,306 9/1942 Peterson ..... 430/543
2,353,754 7/1944 Peterson ..... 430/543
2,401,718 6/1946 Young ..... 430/552
4,226,934 10/1980 Webb et al. ..... 430/544
4,585,731 4/1986 Kobayashi et al. ..... 430/453
4,737,452 4/1988 Kameoka et al. ..... 430/600

*Primary Examiner*—Charles L. Bowers, Jr.
*Assistant Examiner*—Thomas R. Neville
*Attorney, Agent, or Firm*—Connolly and Hutz

[57] ABSTRACT

Light sensitive color photographic silver halide material containing at least one light sensitive silver halide layer with which a conventional diffusion fast color coupler is associated and optionally other layers, both light sensitive and light insensitive, in which material the one or more than one light sensitive silver halide layer contains, at a concentration of $10^{-3}$ to 10 mmol/mol of silver halide, a compound corresponding to the following formula $$A(Z)_nK \quad (I)$$

absorbed on and adhering to the silver halide grain and reacting with the developer oxidation product (EOP) with an effective reaction rate constant of $K_{eff} \geqq 10^3$, in which formula A is a grain active bonding group, Z denotes a divalent intermediate member n is 0 or 1 and K denotes a group which forms a colored or uncolored reaction product in the reaction with the developer oxidation product, is found to have an improved sensitivity/graininess ratio.

3 Claims, 1 Drawing Sheet

COLOR PHOTOGRAPHIC MATERIAL

Figure 1:
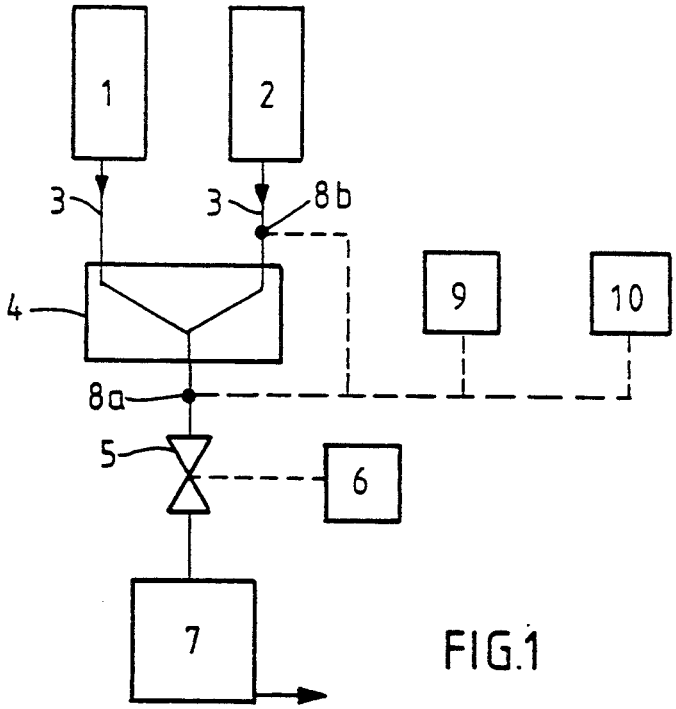

This invention relates to a light sensitive colour photographic silver halide material, in particular a colour negative material, with improved sensitivity/graininess ratio.

It is known to produce coloured photographic images by chromogenic development, i.e. by developing the imagewise exposed silver halide emulsion layers with suitable colour producing developer substances, so called colour developers, in the presence of suitable colour couplers so that the oxidation product of developer substances produced in areas corresponding to the silver image reacts with the colour coupler to form a dye image. The colour developers used are generally aromatic compounds containing primary amino groups, especially those of the p-phenylene diamine series.

One important aim in the work carried out for further improving colour photographic materials is that of increasing the photographic sensitivity. The sensitivity may be increased by using larger silver halide grains but this is generally accompanied by a deleterious effect on the colour graininess.

The sensitivity may also be increased by means of so called development accelerators (e.g. quaternary salts, polyethylene oxides, etc.; see e.g. T. H. James, The Theory of the Photographic Process, MacMillan Co., New york/London, 4th Edition (1977) pages 422 to 426) but increased development of the silver halide grains also increases the colour graininess and there are limits to the effect obtainable with development accelerators. The stability of the (undeveloped) layers containing such development accelerators is generally also impaired, especially in a tropical climate.

The sensitivity may also be increased by using compounds which release an imagewise distribution of fogging or development increasing agents during development. Such compounds are described, for example, in DE-A-3 209 110, DE-A-3 333 355, EP-A-0 117 511 and EP-A-0 118 087. The disadvantage associated with the use of such compounds is generally due to an increase in the latent fog also in the unexposed areas so that images with a greatly increased basic fog are obtained. In addition a coarser colour grain is obtained at least in the areas of low colour densities.

It was an object of the present invention to increase the sensitivity/graininess ratio of light sensitive colour photographic silver halide materials without incurring the disadvantages mentioned above.

It has now surprisingly been found that this may be achieved by using emulsions containing certain concentrations of certain compounds which adhere to the grain and react with the developer oxidation product (EOP).

This invention therefore relates to a light sensitive colour photographic silver halide material containing at least one red sensitive silver halide emulsion layer with at least one non-diffusing cyan coupler, at least one green sensitive silver halide emulsion layer with at least one non-diffusing magenta coupler and at least one blue sensitive silver halide emulsion layer with at least one non-diffusion yellow coupler and optionally other light insensitive layers, characterized in that one or more than one light sensitive silver halide layer contains in addition to the coupler a compound corresponding to the following formula $$A-(Z)_n-K \qquad (I)$$

at a concentration of $10^{-3}$ to 10 mmol, preferably $10^{-2}$ to 1 mmol/mol of silver halide, which compound of formula (I) is absorbed on and adheres to the silver halide grain and reacts to the developer oxidation product (EOP) with an effective reaction rate constant of $k_{eff} \geqq 10^3$, preferably $\geqq 10^4$ 1/mol.s, in which formula A denotes a grain active bonding group corresponding to formulae IIa to IId:

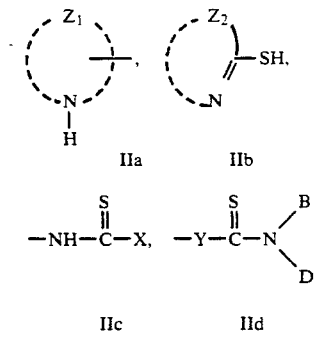

$Z_1$ denotes the remaining members for completing a preferably 5 to 6 membered ring which contains at least one other heteroatom such as a nitrogen or sulphur atom and is optionally benzo or naphtho condensed, $Z_2$ denotes the remaining members for completing a preferably 5 or 6 membered ring which is optionally benzo or naphtho condensed, X denotes $-NH_2$, $-NHR$,

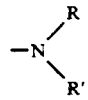

$-NH-NH_2$, $-NH-NHR$ or $-SR$,

Y denotes —S—, —NH— or —NR—,

B and D denote hydrogen or R or together represent the remaining members of a 5 or 6 membered ring, R denotes an aliphatic, aromatic or heterocyclic group, Z denotes a divalent intermediate member n denotes 0 or 1 and K denotes a group which forms a coloured or uncoloured reaction product in the reaction with the developer oxidation product, the group $$A-(Z)_n-$$

being attached to K in a position other than the coupling position of K.

The following are preferred divalent intermediate members Z: alkylene groups, arylene groups, $-COCH_2-$, $-COCH_2-S-$, $-COCH_2-O-$,

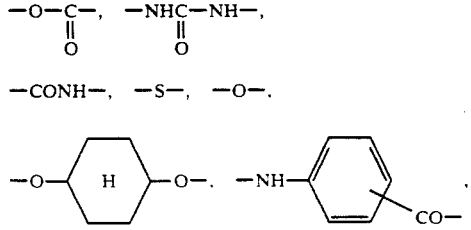

-continued

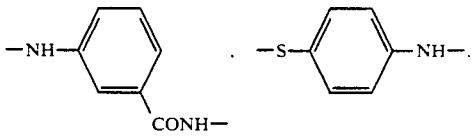

Suitable bonding groups IIa and IIb are derived from the following heterocyclic compounds:

Imidazole, benzotriazole, 1,2,3-triazole, 1,2,4-triazole, benzotriazole, tri-, tetra- and pentaazaindenes such as 1,3,3a, 7tetraazaindene and 1,2,3,3a,7-pentaazaindene, oxazole, thiazole, selenazole, oxadiazole, thiadiazole, tetrazole, pyridine and pyrimidine.

The heterocyclic compounds are optionally substituted, in particular by alkyl, aryl, nitro, amino, hydroxy, caroboxy, sulpho, halogen, cyano, alkylsulphonyl, alkylthio or arylthio, which may in turn be substituted.

The alkyl group is preferably a $C_1$ to $C_4$ alkyl group and the aryl group is preferably phenyl.

The coupling parts K according to the invention are compounds which are capable of reacting with the oxidation product of a colour developer (e.g. p-phenylene diamine derivatives) by virtue of the presence of an active coupling position in the molecule. These compounds include the large class of colour couplers (see Pelz: Mitteilungen aus den Forschungslaboratorien der Agfa, Volume III, pages 111 et seq.), e.g. yellow couplers of the β-ketocarboxylic acid series, magenta couplers of the anilinopyrazolone series, acylaminopyrazolones, cyanoacetophenone, pyrazoloazole magenta couplers, pyrazolobenzimidazoles, phenolic and naphtholic cyan couplers and couplers which form uncoloured coupling products.

The coupling position may be unsubstituted or carry a substituent which is split off in the coupling reaction (fugitive group), e.g. $Cl^-$ or $Br^-$ or the usual fugitive groups of 2-equivalent couplers. The fugitive group may in turn be photographically active such as the fugitive groups found in the known DIR, DAR and FAR couplers. The coupling groups may also be residues of so called white couplers.

The coupling groups may be coloured and give rise in the coupling reaction to a product which may be colourless or of a different colour (masking couplers).

The following are examples of cyan coupling systems:

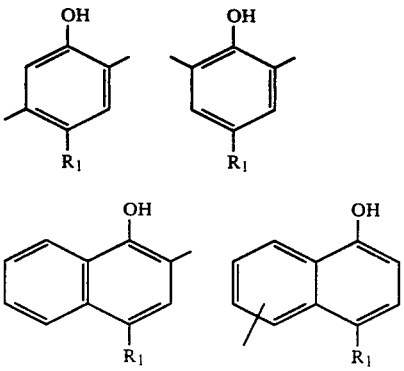

The following are examples of magenta coupling systems:

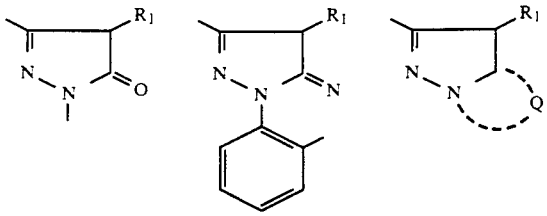

The following are examples of yellow coupling systems:

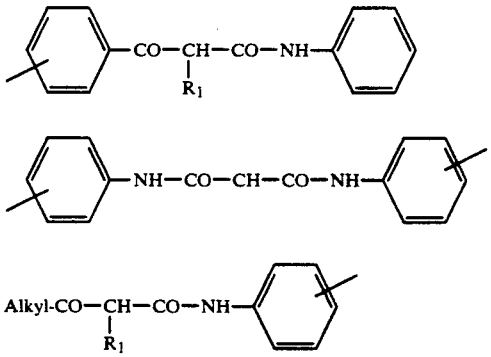

The following are examples of systems which couple to give rise to colourless products:

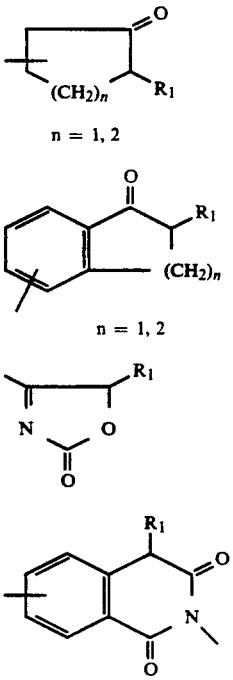

In all cases $R_1$ denotes the coupling position.

The compounds according to the invention of formula I generally do not contain diffusion inhibiting ballast groups such as those present in conventional colour couplers.

Owing to the small quantities in which the compounds of formula I are used and the fact that they are to some extent soluble, they may be dissolved in the usual solvents to be used e.g. in the form of aqueous, aqueous-alkaline or aqueous-alcoholic solutions to be added to the casting solutions. They are preferably added to the silver halide emulsions before the addition of couplers.

The following are examples of bonding groups A:

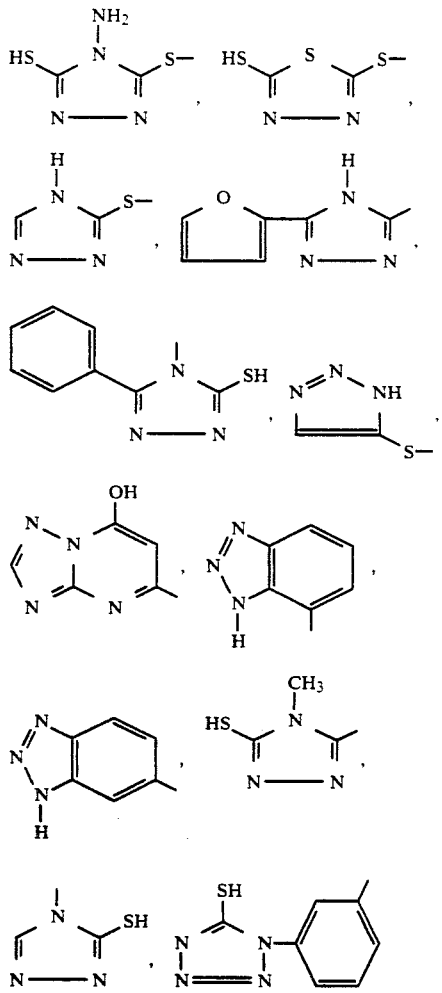

The effective reaction rate constant $k_{eff}$ is determined as follows in the apparatus described below. In the accompanying figures, FIG. 1 shows diagrammatically the overall arrangement of the measuring apparatus and FIG. 2 is a diagram for determining a $k_{eff}$ value obtained by means of this measuring apparatus.

Figure 2:
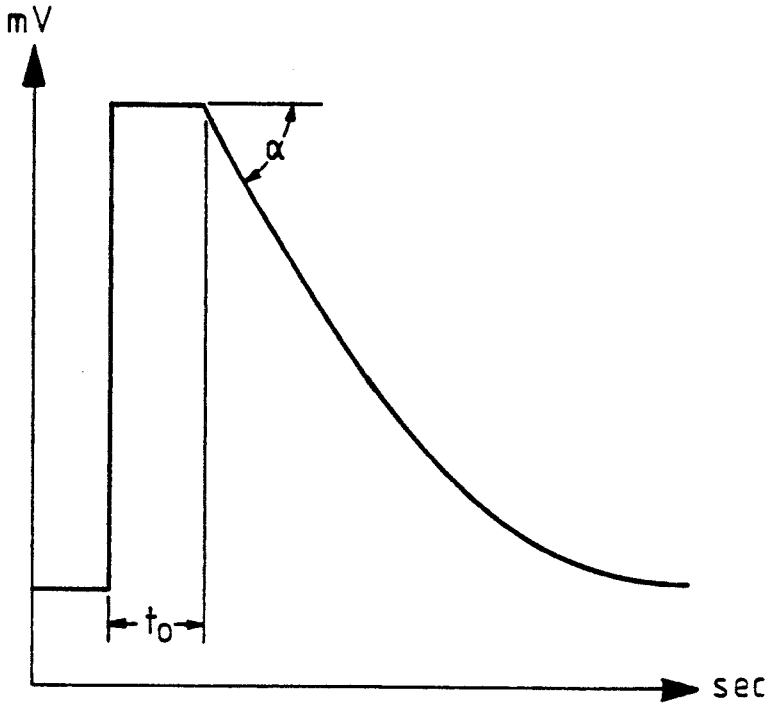

The measuring apparatus illustrated in FIG. 1 comprises the cylindrical storage containers 1 and 2 which are about 25 cm in height, the feed pipes 3 equipped with non-return valves, the mixing chamber 4, the magnetic valve 5 which is closed when at rest and may be opened by means of the impulse transmitter 6, the receiver 7 in which a vacuum is produced and maintained, the measuring electrode 8*a*, the reference electrode 8*b*, the digital mV meter 9 and the recorder 10.

The magnetic valve 5 is opened for a time t by the impulse transmitter 6. Owing to the pressure gradient between the receiver 7 and the storage contains 1 and 2, the liquids in the latter flow through the pipes 3 into the mixing chamber where intensive mixing takes place. The resulting mixture then enters the receiver 7 by way of the magnetic valve 5. The storage container 1 contains an oxidizing agent, e.g. a $10^{-3}$ molar aqueous solution of $K_3[Fe(CN)_6]$. The storage container 2 contains a colour developer, the substance to be investigated and means for adjusting the pH to the required value (buffer), all in aqueous solution. The special colour developer used was 2-methyl-N-ethyl-hydroxyethyl-p-phenylene diamine (concentration: $2\times10^{-3}$ mol). The concentration of the substance to be measured was $10^{-3}$ mol. The pH was adjusted to 10·2 by means of a carbonate/bicarbonate buffer.

The redox potential of the mixture was measured by means of the measuring electrode 8*a* (platinum wire $\phi$ 1 mm). The reference electrode 8*b* was an Ag/AgCl electrode (e.g. an Argenthal cartridge) which in the embodiment shown here is situated in the pipe leading from the storage container 2 to the mixing chamber but which could equally well be arranged next to the platinum electrode in the conventional manner. The redox potential measured in the mixed solutions may be read off be means of the digital mV meter 9 and its variation with time may be recorded by means of the recorder 10 (compensation recorder, oscillograph or light point line recorder).

The change of redox potential with time is shown in FIG. 2. The redox potential measured is entered in mV (along the ordinate) against time in sec. (abscissa) and t stands for the opening time of the magnetic valve. The effective reaction velocity constant $k_{eff}$ can be calculated from the angle $\alpha$ in accordance with the following equation:

$$k_{eff} = \frac{1}{c_o \cdot f}\,(tg\alpha_K - tg\alpha_o)$$

wherein $k_{eff}$ is the reaction velocity constant (1/mol.s), $c_o$ is the initial concentration of the substance to be measured (mol/l), f is the electrochemical constant (R.T/n.F), $\alpha_K$ is the angle $\alpha$ obtained in the presence of the substance to be measured and $\alpha_o$ is the angle $\alpha$ obtained in the absence of the substance to be measured.

When the solutions have been introduced into the storage containers 1 and 2, the mixing chamber 4 and the inlet and discharge pipes are thoroughly rinsed by keeping the magnetic valve 5 open for some time and the containers are then refilled to their original level. The potential/time curve shown in FIG 2 may be obtained by briefly opening the magentic valve 5. The angle $\alpha$ (FIG. 2) between the time axis and the tangent to the measuring curve at the beginning of the reaction is determined, once with the substance to be measured ($\alpha_K$) and once without the substance ($\alpha_o$). The effective reaction velocity constant $k_{eff}$ can be determined by inserting both $\alpha$ values in the above equation.

The finding that the substances according to the invention generally increase the sensitivity to a greater extent when the exposure time is short (exposure time $t<{}^1/_{20}$ sec) than when the exposure time is long ($t>{}^1/_{20}$ sec) indicates that the reactive groups brought directly to the surface of the silver halide probably absorb the developer oxidation product formed immediately at the onset of development, and thereby prevent oxidative destruction of minute latent image nuclei.

The compounds according to the invention are preferably diffusible so that they are not fixed in the intermediate phase between the silver halide grains. Water soluble compounds or compounds which are soluble in water miscible organic solvents such as methanol or acetone are therefore to be preferred.

The substances according to the invention are used in particular in quantities of $10^{-3}$ to 10 mmol, preferably $10^{-2}$ to 1 mmol/mol of silver halide. As a rule, the photographic sensitivity first increases with increasing quantities of substance used and then decreases. The optimum quantity within the given range may easily be determined by simple tests.

It may also be advantageous to use mixtures of different types of the compounds according to the invention. In multilayered materials, several types of the compounds according to the invention may be used in the individual layers.

Since the diffusion fast colour coupler also present in the layer to give rise to the image dye is generally present in much larger quantities in that layer than the compounds according to the invention, and since the products of reaction of the compounds according to the invention with the developer oxidation products generally disappear from the layer in the course of processing, the colour of these reaction products only plays a minor role. The reaction product may be colourless, yellow, magenta, cyan, blue, green or red or any other colour.

The following are examples of compounds of formula I:

HK1

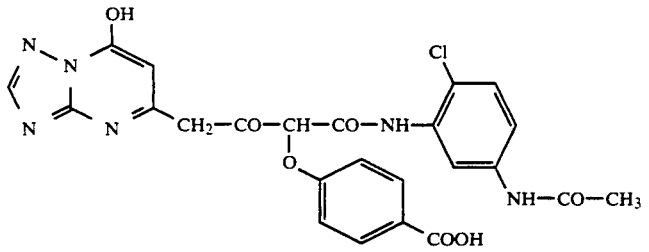

HK2

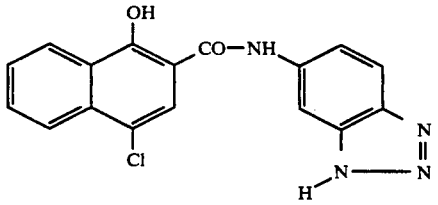

HK3

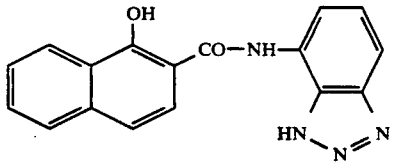

HK4

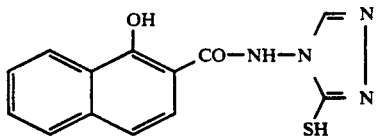

HK5

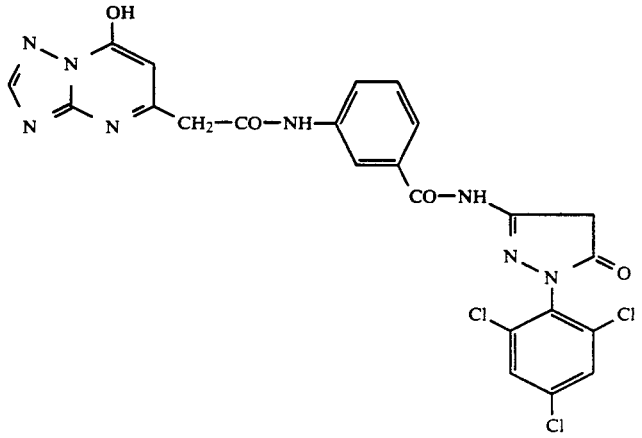

-continued
HK6
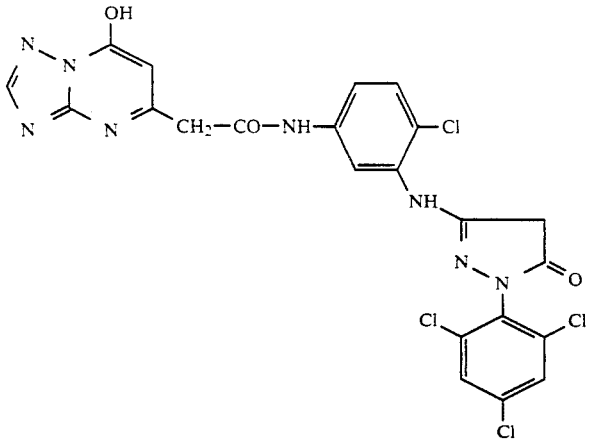
HK7
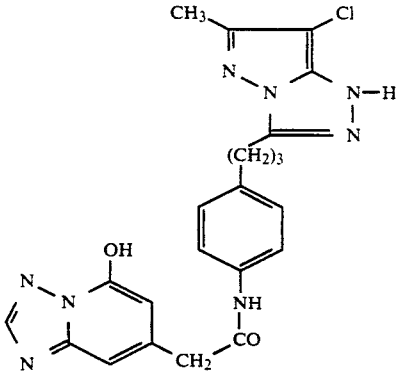
HK8
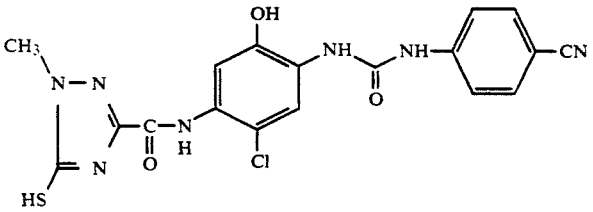
HK9
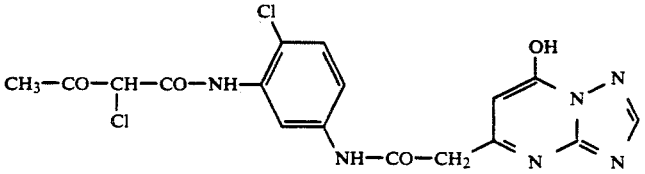
HK10
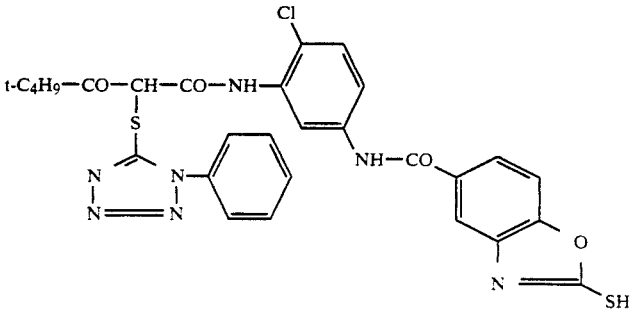

-continued
HK11
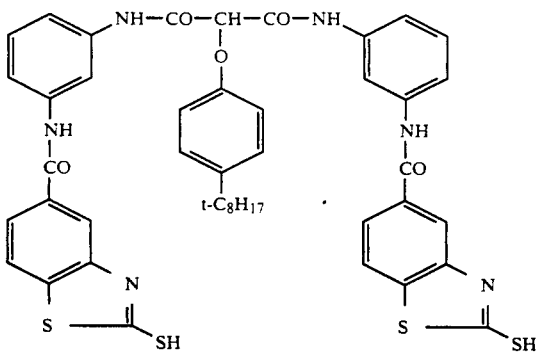
HK12
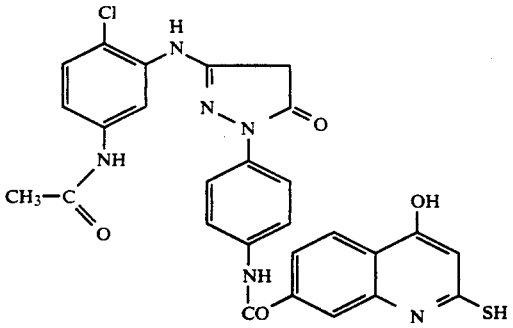
HK13
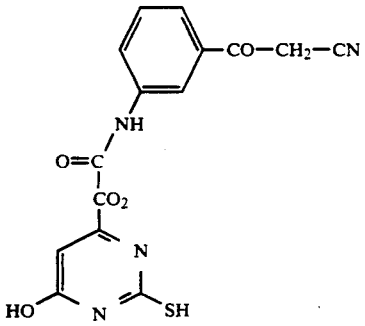
HK14
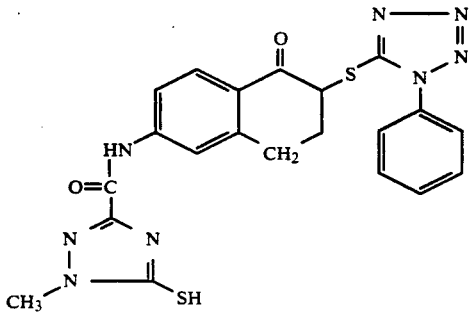
HK15
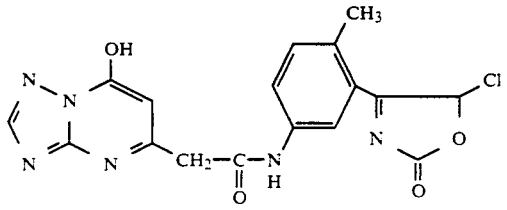

-continued
HK16
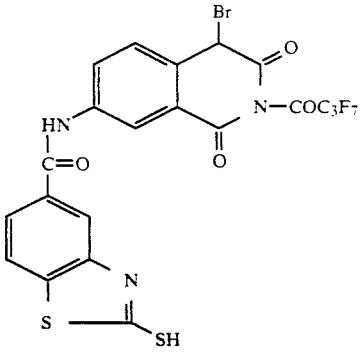
HK17
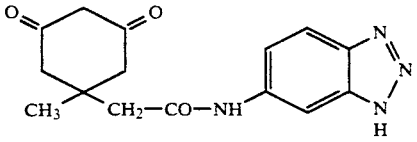
HK18
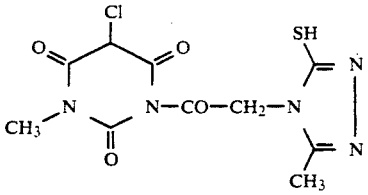
HK19
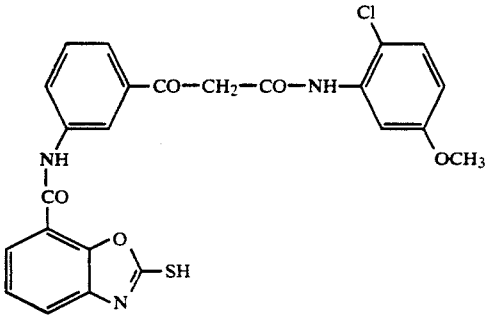
HK20
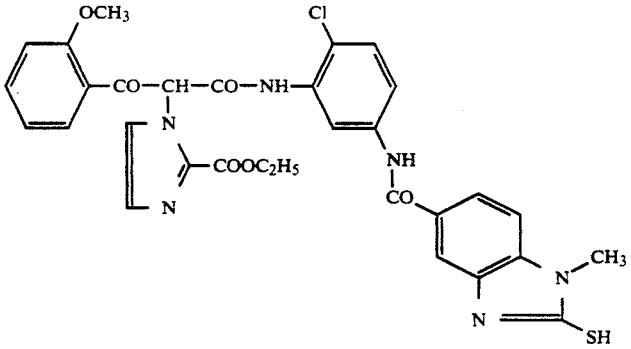
HK21
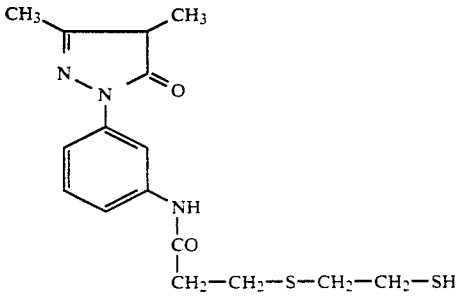

-continued
HK22
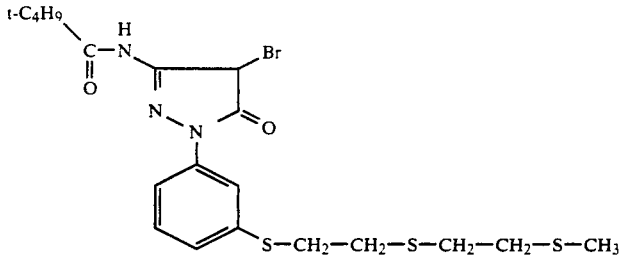
HK23
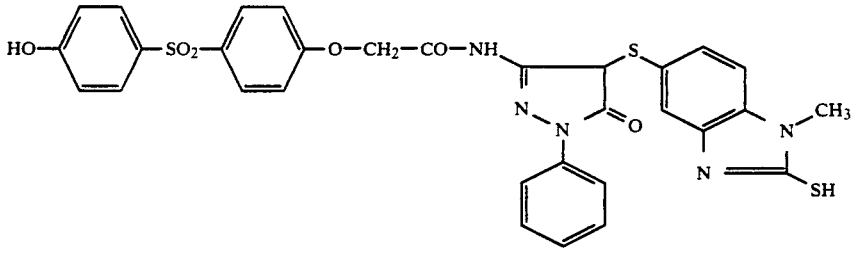
HK24
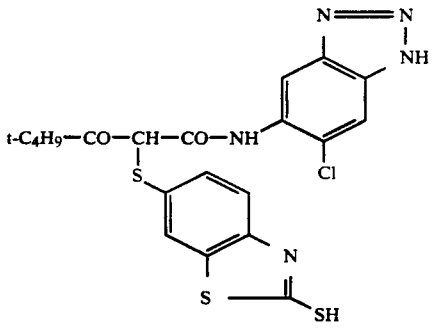
HK25
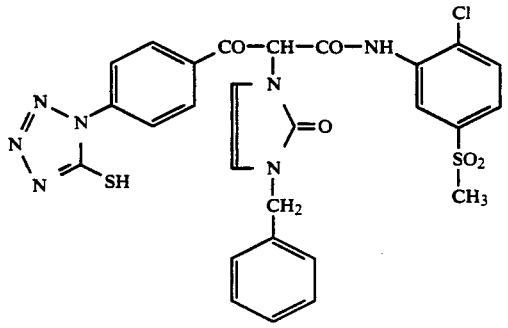
HK26
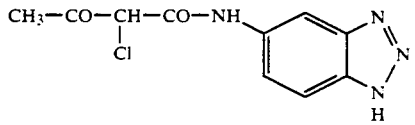

-continued
HK27
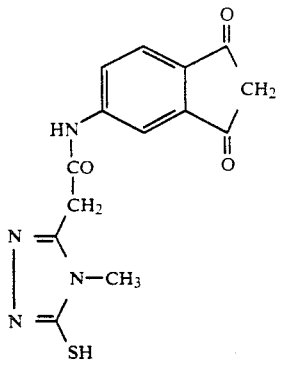
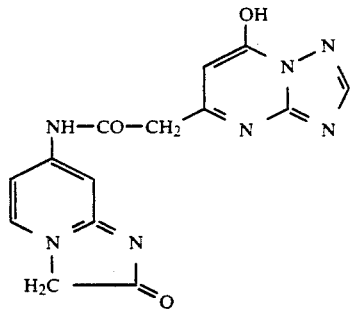
HK28
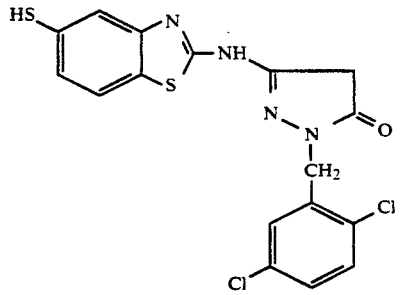
HK29
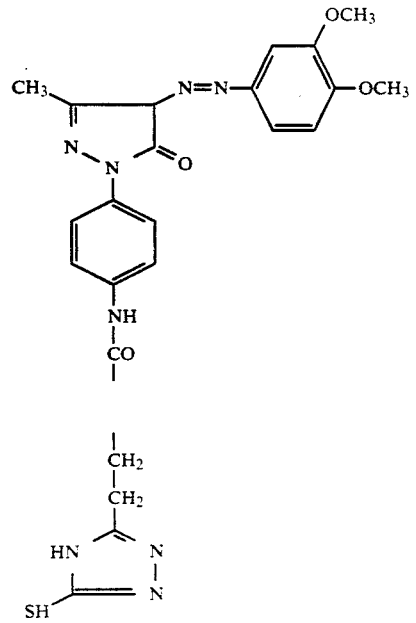

-continued
HK30
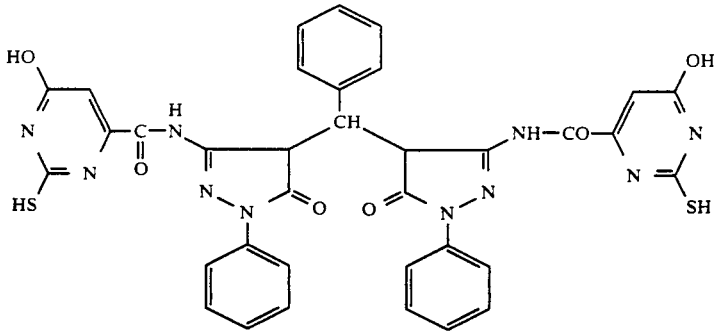
HK31
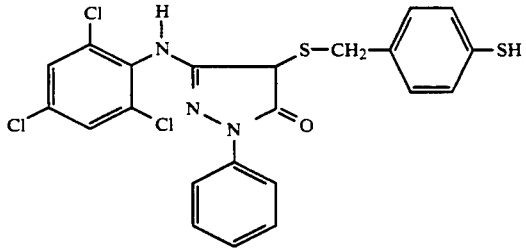
HK32
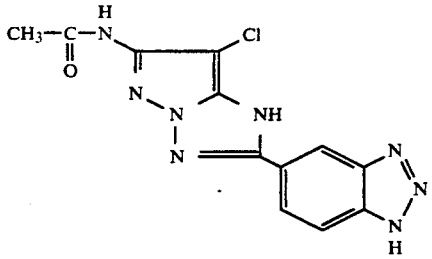
HK33
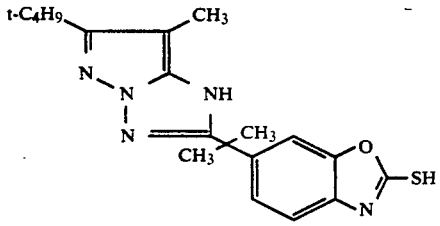
HK34
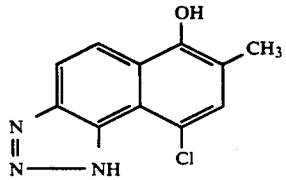
HK35
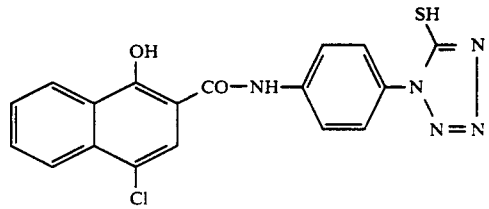

-continued
HK36
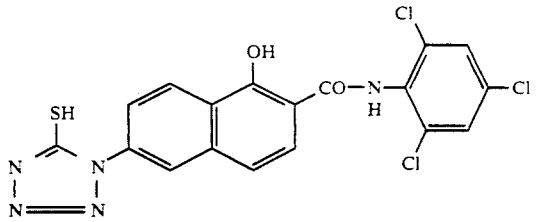
HK37
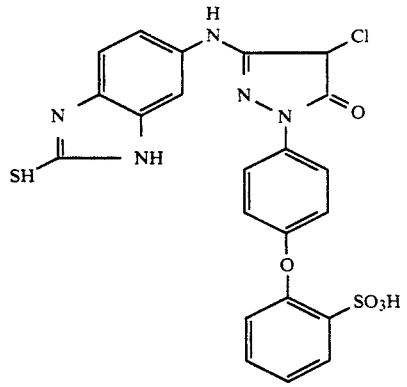
HK38
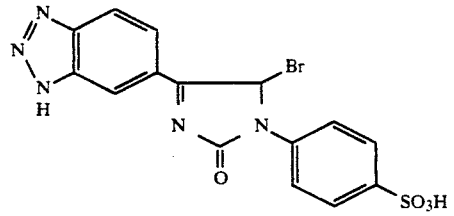
HK39
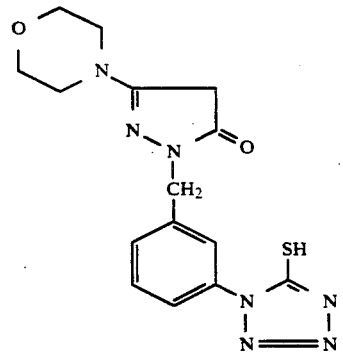
HK40
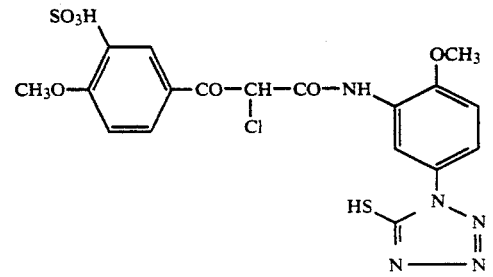
HK41
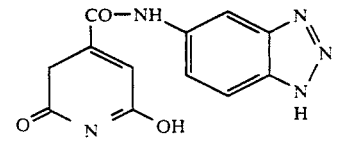

-continued
HK42
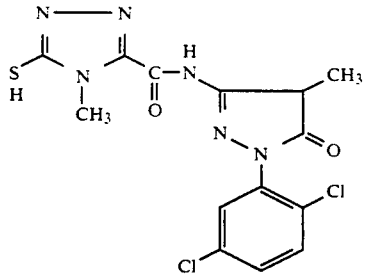
HK43
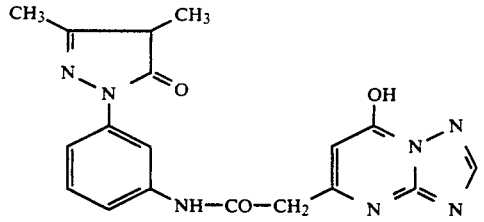
HK44
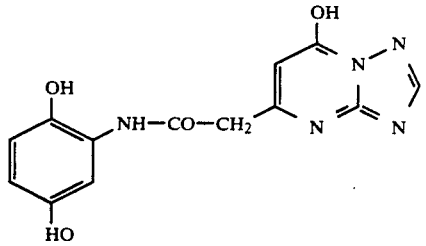
HK45
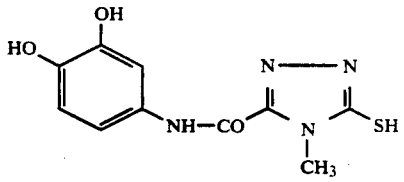
HK46
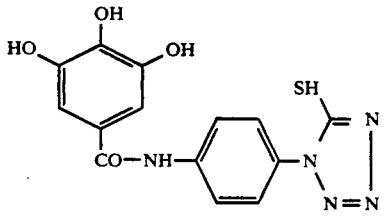
HK47
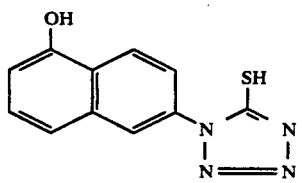
HK48
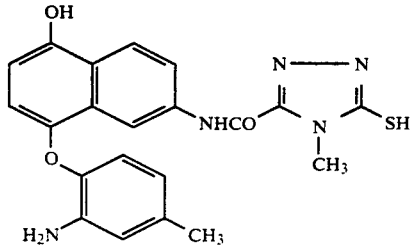

All compounds HK 1 to HK 48 have coupling rates of $k_{eff} > 10^4$.

The following are examples of colour photographic materials: colour negative films, colour reversal films, colour positive films, colour photographic paper, colour reversal photographic paper and colour sensitive materials for the diffusion transfer process or the silver dye bleaching process.

Examples of suitable supports for the preparation of colour photographic materials include films and foils of semi-synthetic and synthetic polymers such as cellulose nitrate, cellulose acetate, cellulose butyrate, polystyrene, polyvinyl chloride, polyethylene terephthalate and polycarbonate and paper laminated with a baryta layer or an α-olefine polymer layer (e.g. polyethylene). These supports may be coloured with dyes and pigments, e.g. titanium dioxide. They may also be coloured black for the purpose of shielding off light. The surface of the support is generally subjected to a treatment to improve the adherence of the photographic emulsion layer, for example a corona discharge treatment followed by the application of a substrate layer.

The colour photographic materials normally contain at least one red sensitive, one green sensitive and one blue sensitive silver halide emulsion layer and optionally also interlayers and protective layers.

Binders, silver halide grains and colour couplers are essential components of the photographic emulsion layers.

The binder used is preferably gelatine but this may be partly or completely replaced by other synthetic, semi-synthetic or naturally occurring polymers. Examples of synthetic gelatine substitutes include polyvinyl alcohols, poly-N-vinyl pyrrolidone, polyacrylamides, polyacrylic acid and derivatives thereof, especially their copolymers. Examples of naturally occurring gelatine substitutes include other proteins, such as albumin or casein, cellulose, sugar, polysaccharides, starches and alginates. Semi-synthetic gelatine substitutes are generally modified natural products. Cellulose derivatives such as hydroxyalkyl cellulose, carboxymethyl cellulose and phthalyl cellulose and gelatine derivatives obtained by a reaction with alkylating or acylating agents or by grafting polymerisable monomers are examples of these.

The binders should contain a sufficient quantity of functional groups so that sufficiently resistant layers can be produced by a reaction with suitable hardeners. These functional groups are mainly amino groups but may also be carboxyl groups, hydroxyl groups or active methylene groups.

Gelatine, which is the binder preferably used, may be obtained by acid or alkaline decomposition but oxidized gelatine may also be used. The preparation of such gelatines is described, for example, in The Science and Technology of Gelatine, published by A. G. Ward and A. Courts, Academic Press 1977, pages 295 et seq. The gelatine used should contain as little photographically active impurities as possible (inert gelatine). Gelatines having a high viscosity and low swelling are particularly advantageous.

The halide of the silver halide present as light sensitive component of the photographic material may be chloride, bromide, iodide or mixtures thereof. For example, the halide content of at least one layer may consist of 0 to 15 mol % of iodide, 0 to 100 mol % of chloride and 0 to 100 mol % of bromide. Silveriodobromide emulsions are generally used for colour negative and colour reversal films and silverchlorobromide emulsions with a high chloride content up to pure silver chloride emulsions are generally used for colour negative and colour reversal paper. The silver halides may consist predominantly of compact crystals which may e.g. be regular cubes or octahedrons or transitional forms but platelet shaped crystals in which the average ratio of diameter to thickness is preferably at least 5:1 may advantageously also be present, the diameter of a grain being defined as the diameter of a circle having an area equal to the projected surface area of the grain. The layers may also contain tabular silver halide crystals in which the ratio of diameter to thickness is substantially greater than 5:1, e.g. from 12:1 to 30:1.

The silver halide grains may also have a multilayered grain structure, in the simplest case comprising an inner and an outer grain region (core/shell), the individual grain regions differing from one another in their halide composition and/or other modifications such as doping. The average grain size of the emulsions is preferably from 0·2 μm to 2·0 μm and the grain size distribution may be either homodisperse or heterodisperse. A homodisperse grain distribution means that 95% of the grains deviate by not more than ±30% from the average grain size. The emulsions may contain organic silver salts in addition to the silver halide, e.g. silverbenzotriazolate or silverbehenate.

Two or more separately prepared types of silver halide emulsions may be used as a mixture.

The photographic emulsions may be prepared from soluble silver salts and soluble halides by various methods, (e.g. P. Glafkides, Chimie et Physique Photographique, Paul Montel, Paris (1967), G. F. Duffin, Photographic Emulsion Chemistry, The Focal Press, London (1966), V. I. Zelikman et al, Making and Coating Photographic Emulsions, The Focal Press, London (1966)).

Precipitation of the silver halide preferably takes place in the presence of the binder, e.g. gelatine, and may be carried out at an acid, neutral or alkaline pH, preferably with the addition of silver halide complex formers. Examples of the latter include ammonia, thio ethers, imidazole, ammonium thiocyanate and excess halide. The water soluble silver salts and the halides may selectively be brought together either successively by the single jet process or simultaneously by the double jet process or by any combination of the two processes. The substances are generally added at increasing inflow rates but without exceeding the "critical" inflow rate at which new nuclei just fail to be formed. The pAg range may vary within wide limits during precipitation; the so called pAg controlled process is preferably employed in which the pAg is either kept constant at a particular value or made to pass through a particular profile during precipitation. Apart from the preferred method of precipitating with a halide excess, the so called inverse method of precipitation with an excess of silver ions may be employed. The silver halide crystals may be made to grow not only be precipitation but also by physical ripening (Ostwald ripening) in the presence of excess halide and/or silver halide complex formers. Growth of the emulsion grains may even take place predominantly by Ostwald ripening, in which case a fine grained, so called Lippmann emulsion is preferably mixed with a sparingly soluble emulsion and redissolved on the latter.

Salts or complexes of metals such as Cd, Zn, Pb, Tl, Bi, Ir, Rh or Fe may be present during precipitation and/or physical ripening of the silver halide grains.

Precipitation may also be carried out in the presence of sensitizing dyes. Complex forming agents and/or dyes may be rendered inactive at any stage, e.g. by alteration of the pH or by means of an oxidative treatment.

When crystal formation has been completed or at an earlier stage, the soluble salts are removed from the emulsion, e.g. by shredding and washing, by flocculation and washing, by ultrafiltration or by means of ion exchangers.

The silver halide emulsion is generally subjected to a chemical sensitization under specified conditions of pH, pAg, temperature and concentration of gelatine, silver halide and sensitizer until the sensitivity and fog optimum have been reached. The procedure is described, for example, by H. Frieser in "Die Grundlagen der Photographischen Prozesse mit Silberhalogeniden", pages 675 to 743, Akademische Verlagsgesellschaft (1968).

Chemical sensitization may be carried out with the addition of compounds of sulphur, selenium or tellurium and/or compounds of the metals of subgroup VIII of the periodic system (e.g. gold, platinum, palladium or irridium). Thiocyanate compounds, surface active compounds such as thio ethers, heterocyclic nitrogen compounds (e.g. imidazoles, azaindenes) or spectral sensitizers (described e.g. by F. Hamer in "The Cyanine Dyes and Related Compounds", 1964, and Ullmanns Encyclopädie der technischen Chemie, 4th Eition, volume 18, pages 431 et seq. and Research Disclosure No. 17 643, section III) may also be added. Instead of this procedure or in addition thereto, a reduction sensitization may be carried out with the addition of reducing agents (tin-II salts, amines, hydrazine derivatives, amino boranes, silanes, formamidine sulphinic acid), by means of hydrogen or by employing a low pAg (e.g. below 5) and/or a high pH (e.g. above 8).

The photographic emulsions may contain compounds for preventing fogging or for stabilizing the photographic function during production, storage or photographic processing.

Azaindenes are particularly suitable, especially tetra and pentaazaindenes and particularly those which are substituted with hydroxyl or amino groups. Compounds of this type are described e.g. by Birr in Z. Wiss. Phot. 47 (1952), pages 2 to 58. Further, salts of metals such as mercury or cadmium, aromatic sulphonic or sulphinic acids such as benzene sulphinic acid and nitrogen-heterocyclic compounds such as nitrobenzimidazole, nitroindazole and substituted or unsubstituted benzotriazoles or benzothiazolium salts may be used as antifoggants. Heterocyclic compounds containing mercapto groups are particularly suitable, e.g. mercapto benzothiozoles, mercaptobenzimidazoles, mercaptotetrazoles, mercaptothiadiazoles and mercaptopyrimidines. These mercapto azoles may also contain a water solubilizing group, e.g. a carboxyl group or a sulpho group. Other suitable compounds are published in Research Disclosure No. 17 643 (1978), section VI.

The stabilizers may be added to the silver halide emulsions before, during or after ripening. The compounds may, of course, also be added to other photographic layers associated with a silver halide layer.

Mixtures of two or more of the above mentioned compounds may be used.

The photographic emulsion layers or other hydrophilic colloid layers of the light sensitive material prepared according to the invention may contain surface active agents for various purposes, such as coating auxiliaries, substances for preventing electric charging, for improving the slip properties, for emulsifying the dispersion, for preventing adhesion and for improving the photographic characteristics (e.g. development acceleration, high contrast, sensitization, etc.). Apart from naturally occurring surface active compounds such as saponin, the surface active compounds used are mainly synthetic compounds (tensides) of the following types: non-ionic surfactants such as alkylene oxide compounds, glycerol compounds and glycidol compounds; cationic surfactants such as higher alkylamines, quaternary ammonium salts, pyridine compounds and other heterocyclic compounds, sulphonium compounds and phosphonium compounds; anionic surfactants containing an acid group, e.g. a carboxylic, sulphuric or phosphoric acid or sulphuric acid ester or phosphoric acid ester group; and ampholytic sufactants such as amino acid compounds and aminosulphinic acid compounds and sulphuric or phosphoric acid esters of an amino alcohol.

The photographic emulsions may be spectrally sensitized by means of methine dyes or other dyes. Cyanine dyes, merocyanine dyes and complex merocyanine dyes are particularly suitable.

A survey of the polymethine dyes suitable for use as spectral sensitizers and suitable combinations thereof and combinations which have a supersensitizing action are given in Research Disclosure 17 643/1978, section IV.

The following dyes, ordered according to their spectral regions, are particularly suitable:

1. as red sensitizers:

9-ethylcarbocyanines containing benzothiozole, benzoselenazole or naphthothiazole as basic end groups, which may be substituted in 5- and/or 6-position by halogen, methyl, methoxy, carbalkoxy or aryl, and 9-ethyl-naphthoxathia- or -selenocarbocyanines and 9-ethyl-naphthothiaoxa- or -benzimidazocarbocyanines, provided the dyes contain at least one sulpho alkyl group on the heterocyclic nitrogen.

2. as green sensitizers:

9-ethylcarbocyanines containing benzoxazole, naphthoxyazole or a benzoxazole and a benzothiazole as basic end groups and benzimidazocarbocyanines which may be further substituted and must also contain at least one sulpho alkyl group on the heterocyclic nitrogen.

3. as blue sensitizers:

symmetric or asymmetric benzimidazo, oxa, thia, or selena-cyanines containing at least one sulphoalkyl group on the heterocyclic nitrogen and optionally other substituents on the aromatic nucleus, and apomerocyanines containing a rhodanine group.

Sensitizers may be omitted if the intrinsic sensitivity of the silver halide is sufficient for a particular spectral region, for example the blue sensitivity of silver bromides.

The variously sensitized emulsion layers have non-diffusible monomeric or polymeric colour couplers associated with them, which may be placed in the same layer or in adjacent layer. Cyan couplers are generally associated with the red sensitive layers, magenta couplers with the green sensitive layers and yellow couplers with the blue sensitive layers.

Colour couplers for producing the cyan partial colour image are generally couplers of the phenol or 60 -naphthol series.

Colour couplers for producing the magenta partial colour image are generally couplers of the 5-pyrazolone series, the indazolone series or the pyrazoloazole series.

Colour couplers for producing the yellow partial colour image are generally couplers containing an open chain ketomethylene group, in particular couplers of the α-acyl acetamide series. Suitable examples of these include α-benzolylacetanilide couplers and α-pivalolyacetanilide couplers.

The colour couplers may be 4-equivalent couplers or 2-equivalent couplers. The latter are derived from 4-equivalent couplers in that they carry, in the coupling position, a substituent which is split off in the coupling reaction. 2-equivalent couplers include colourless couplers as well as couplers which have an intense colour of their own which disappears in the process of colour coupling to be replaced by the colour of the image dye produced (masking couplers) as well as white couplers which give rise mainly to colourless products in their reaction with colour developer oxidation products. Also to be included among the 2-equivalent couplers are those couplers in which the coupling position carries a fugitive group which is released in the reaction with colour developer oxidation products and then develops a particular photographic activity, e.g. as development inhibitor or accelerator, either directly or after one or more further groups have been split of from the original fugitive group (e.g. DE-A-27 03 145, DE-A-28 55 697, DE-A-31 05 026 and DE-A-33 19 428). The known DIR couplers and DAR and FAR couplers are examples of such 2-equivalent couplers.

DIR couplers which release development inhibitors of the azole series, e.g. triazoles or benzotriazoles, are described in DE-A-24 14 006, 26 10 546, 26 59 417, 27 54 281, 27 26 180, 36 219, 36 30 564, 36 36 824, 36 44 416 and 28 42 063. Further advantages for colour reproduction, i.e. colour separation and colour purity, and for reproduction of details, i.e. sharpness and graininess, may be obtained with DIR couplers of the type which, for example, do not split off the development inhibitor directly as a consequence of the coupling reaction with an oxidized colour developer but only after an additional reaction which is obtained, for example, with a time control group. Examples of these are described in DE-A-28 55 697, 32 99 671, 38 18 231 and 35 18 797, EP-A-157 146 and 204 175, U.S. Pat Nos. 4,146,396 and 4,438,393 and GB-A-2 072 363.

DIR couplers releasing a development inhibitor which is decomposed in the developer bath into products which are photographically substantially inactive are described, for example, in DE-A-32 09 486 and in EP-A-167 168 and 219 713. Trouble free development and constancy of processing are obtained by using such couplers.

If suitable measures are carried out for optical sensitization, improvements in colour reproduction, e.g. differential colour reproduction, may be obtained by using DIR couplers, especially those which split off a readily diffusible development inhibitor, as described e.g. in EP-A-115 304 and 167 173, GB-A-2 165 058, DE-A-37 00 419 and U.S. Pat. No. 4,707,436. In a multilayered photographic material, the DIR couplers may be added to various different layers, e.g. to light insensitive layers or interlayers, but they are preferably added to the light sensitive silver halide emulsion layers, in which case the photographic properties obtained are influenced by the characteristic properties of the silver halide emulsion, e.g. its iodide content, the structure of the silver halide grains or the grain size distribution. The influence of the inhibitors released may be limited, for example by the incorporation of an inhibitor receptor layer according to DE-A-24 31 223. It may be advantageous for reasons of reactivity or stability to use a DIR coupler which gives rise in the coupling reaction to a colour which is different from the colour required to be produced in the layer into which it has been introduced.

DAR and FAR couplers which split off a development accelerator or a foggant are particularly useful for increasing the sensitivity, the contrast and the maximum density. Compounds of this type are described, for example, in DE-A-25 34 466, 32 09 110, 33 33 355, 34 10 616, 34 29 545 and 34 41 823, EP-A-89 834, 110 511, 118 087 and 147 765 and U.S. Pat. Nos. 4,618,572 and 4,656,123. For an example of the use of BAR couplers (bleach accelerator releasing coupler) see EP-A-193 389.

It may be advantageous to modify the action of a photographically active group split off from a coupler by causing this group to undergo an intermolecular reaction with another group after it has been released, as described in DE-A-35 06 805.

Since the DIR, DAR and FAR couplers are required mainly for the activity of the group released in the coupling reaction and the colour producing properties of these couplers is less important, DIR, DAR and FAR couplers which give rise mainly to colourless products in the coupling reaction are also suitable (DE-A-15 47 460).

The removable group may also be a ballast group so that the reaction with colour developer oxidation products gives rise to coupling products which are diffusible or at least have a weak or limited mobility (U.S. Pat. No. 4,420,556).

The material may also contain compounds which are not couplers but are capable of releasing, for example, a development inhibitor, a development accelerator, a bleaching accelerator, a developer, a silver halide solvent, a foggant or an antifoggant, for example the so called DIR hydroquinones and other compounds, as described, for example, in U.S. Pat. Nos. 4,636,546, 4,354,024 and 4,684,604, DE-A-31 45 640, 25 15 213 and 24 47 079 and EP-A-198 438. These compounds fulfil the same function as DIR, DAR and FAR couplers except that they do not give rise to coupling products.

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and U.S. Pat. No. 4,080,211. The high molecular weight colour couplers are generally prepared by the polymerisation of ethylenically unsaturated monomeric colour couplers but they may also be obtained by polyaddition or polycondensation.

The incorporation of the couplers or other compounds in silver halide emulsion layers may be carried out by first preparing a solution, dispersion or emulsion of the compound and then adding this to the casting solution for the layer in which it is required. The choice of suitable solvents or dispersing agents depends on the particular solubility of the compound.

Methods for introducing substantially water insoluble compounds by grinding processes are described in DE-A-26 09 741 and DE-A-26 09 742.

Hydrophobic compounds may also be introduced into the casting solution by means of high boiling solvents, so called oil formers. Suitable methods for this procedure are described, for example, in U.S. Pat. No. 2,322,027, U.S. Pat. No. 2,801,170, U.S. Pat. No. 2,801,171 and EP-A-0 043 037.

Oligomeric or polymeric compounds known as polymeric oil formers may be used instead of the high boiling solvents.

The compounds may also be introduced into the casting solution in the form of charged latices; see, for example, DE-A25 41 230, DE-A-25 41 274, DE-A-28 35 856, EP-A-0 014 921, EP-A-0 069 671, EP-A-0 130 115 and U.S. Pat. No. 4,291,113.

Diffusion fast incorporation of anoinic water soluble compounds (e.g. dyes) may also be carried out by means of cationic polymers, so called mordanting polymers.

The following are examples of suitable oil formers: phthalic acid alkyl esters, phosphic acid esters, phosphoric acid esters, citric acid esters, benzoic acid esters, amides, fatty acid esters, trimesic acid esters, alcohols, phenols, aniline derivatives and hydrocarbons.

The following are examples of suitable oil formers: dibutyl phthalate, dicyclohexyl phthalate, di-2-ethylhexyl phthalate, decyl phthalate, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexylbenzoate, dodecyl benzoate, 2-ethylhexyl-p-hydroxy benzoate, diethyldodecanamide, N-tetradecylpyrrolidone, isostearyl alcohol, 2,4-di-tert-amyl phenol, dioctyl acetate, glycerol tributyrate, isostearyl lactate, trioctyl citrate, N,N-dibutyl-2-butoxy-5-tert-octyl aniline, paraffin, dodecyl benzene and diisopropyl naphthalene.

Each of the differently sensitized light sensitive layers may consist of a single layer or of two or more silver halide emulsion partial layers (DE-C-1 121 470). Red sensitive silver halide emulsion layers are frequently arranged closer to the layer support than green sensitive silver halide emulsion layers, which in turn are arranged closer to the support than blue sensitive layers, and a light insensitive yellow filter layer is generally inserted between the green sensitive layers and the blue sensitive layers.

If the green sensitive or red sensitive layers have sufficient intrinsic sensitivity, the yellow filter layer may be omitted and other layer arrangements employed in which, for example, the blue sensitive layers are arranged on the support, followed by the red sensitive layers and finally the green sensitive layers.

The light insensitive interlayers generally placed between layers differing in their spectral sensitivity may contain substances to prevent unwanted diffusion of developer oxidation products from one light sensitive layer into another light sensitive layer of a different spectral sensitization.

Suitable substances, also known as scavengers or EOP acceptors, are described in Research Disclosure 17 643 (December 1978), Chapter VII, 17 842/1979, pages 94 to 97, and 18.716/1979, page 650, and in EP-A-69 070, 98 072, 124 877 and 125 522 and U.S. Pat. No. 463,226.

If a material contains several partial layers of the same spectral sensitization, these may differ from one another in their composition, in particular in the nature and quantity of the silver halide grains. The more highly sensitive partial layer is generally arranged further away from the support than the less sensitive partial layer. Partial layers which have the same spectral sensitization may be arranged adjacent to one another or separated by other layers, e.g. by layers of a different spectral sensitization. Thus, for example, all highly sensitive layers may be combined to form one layer packet and all less sensitive layers may be combined to form another layer packet (DE-A-19 58 709, DE-A-25 30 645 and DE-A-26 22 922).

The photographic material may also contain UV light absorbant compounds, white toners, spacers, filter dyes, formalin acceptors, light protective agents, antioxidants, $D_{min}$ dyes, additives for improving the stabilization of the dyes, couplers and whites and for reducing the colour fog, plasticizers (latices), biocides, etc.

UV light absorbent compounds are required to protect the image dyes against bleaching by daylight which has a high UV content and to act as filter dyes for absorbing the UV light present in the daylight ued for exposure, thereby improving the colour reproduction of a film. Compounds of different structures are normally used for the two different functions. Examples of UV light absorbent compounds include aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229 and benzoxazole compounds (U.S. Pat. No. 3,700,455).

Ultraviolet absorbent couplers (such as cyan couplers of the α-naphthol series) and ultraviolet absorbent polymers may also be used. These untraviolet absorbents may be fixed in a particular layer by mordanting.

Filter dyes suitable for visible light include oxonole and hemioxonole dyes, styryl dyes, merocyanine dyes, cyanine dyes and azo dyes. Among these, oxonole dyes, hemioxonole dyes and merocyanine dyes are particularly suitable.

Suitable white toners are described, for example, in Research Disclosure 17 643 (December 1978), Chapter V, in U.S. Pat. Nos. 2,632,701 and 3,269,840 and in GB-A-852 075 and 1 319 763. Certain layers of binders, especially those furthest removed from the support but occasionally also interlayers, especially if they have been furthest removed from the support during the preparation of the layers, may contain photographically inert particles of an inorganic or organic nature, e.g. as matting agents or as spacers (DE-A-33 31 542, DE-A-34 24 893 and Research Disclosure 17 643 (December 1978), Chapter XVI).

The average particle diameter of the spacers is mainly in the range of from 0·2 to 10 μm. The spacers are insoluble in water and may be soluble or insoluble in alkalis. Those which are soluble in alkalis are generally removed from the photographic material by the alkaline development bath. The following are examples of suitable polymers: polymethyl methacrylate, copolymers of acrylic acid and methyl methacrylate, and hydroxypropyl methyl cellulose hexahydro phthalate.

Additives for improving the stability of the dyes, couplers and whites and for reducing the colour fog (Research Disclosure 17 643/1978, chapter VII) may belong to the following classes of chemical compounds: hydroquinones, 6-hydroxychromans, 5-hydroxycoumarans, spirochromans, spiroindanes, p-alkoxyphenols, sterically hindered phenols, gallic acid derivatives, methylene dihydroxy benzenes, aminophenols, sterically hindered amines, derivatives containing esterified or etherified phenolic hydroxyl groups, and metal complexes.

Compounds containing both a sterically hindered amine partial structure and a sterically hindered phenol partial structure in one and the same molecule (U.S. Pat. No. 4,268,593) are particularly effective in preventing any impairment (deterioration or degradation) of the yellow colour images as the result of the evolution of heat or the presence of moisture and light. Spiroindanes (JP-A-159 644/81) and chromans substituted with hydroquinone diethers or monoethers (JP-A-89 835/80) are particularly effective in preventing impairment (deterioration or degradation) of magenta colour images, especially impairment (deterioration or degradation) due to the action of light.

The layers of the photographic material may be hardened with the usual hardeners. Examples of suitable hardeners include formaldehyde, glutaraldehyde and similar aldehyde compounds, diacetyl, cyclopentadione and similar ketone compounds, bis-(2-chloroethyl urea), 2-hydroxy-4,6-dichloro-1,3,5-triazine and other compounds containing reactive halogen (U.S. Pat. No. 3,288,775, U.S. Pat. No. 2,732,303, GB-A-974 723 and GB-A-1 167 207), divinyl sulphone compounds, 5-acetyl-1,3-diacryloyl-hexahydro-1,3,5-triazine and other compounds containing a reactive olefine bond (U.S. Pat. No. 3,635,718, U.S. Pat. No. 3,232,763 and GB-A-994 869); N-hydroxymethyl phthalimide and other N-methylol compounds (U.S. Pat. No. 2,732,316 and U.S. Pat. No. 2,586,168); isocyanates (U.S. Pat. No. 3,103,437); aziridine compounds (U.S. Pat. No. 3,017,280 and U.S. Pat. No. 2,983,611); acid derivatives (U.S. Pat. No. 2,725,294 and U.S. Pat. No. 2,725,295); compounds of the carbodiimide series (U.S. Pat. No. 3,100,704); carbamoylpyridinium salts (DE-A-22 25 230 and DE-A-24 39 551); carbamoyloxypyridinium compounds (DE-A-24 08 814); compounds containing a phosphorus-halogen bond (JP-A-113 929/83); N-carbonyloximide compounds (JP-A-43353/81); N-sulphonyloximido compounds (U.S. Pat. No. 4,111,926), dihydroquinoline compounds (U.S. Pat. No. 4,013,468), 2-sulphonyloxypyridinium salts (JP-A-110 762/81), formamidinium salts (EP-A-O 162 308), compounds containing two or more N-acyloximino groups (U.S. Pat. No. 4,052,373), epoxy compounds (U.S. Pat. No. 3,091,537), compounds of the isoxazole series (U.S. Pat. No. 3,321,313 and U.S. Pat. No. 3,543,292); halogenocarboxyaldehydes such as mucochloric acid; dioxane derivatives such as dihydroxydioxane and dichlorodioxane; and inorganic hardeners such as chrome alum and zirconium sulphate.

Hardening may be brought about in known manner by adding the hardener to the casting solution for the layer to be hardened or by coating the layer to be hardened with a layer containing a diffusible hardener.

The classes mentioned above include both slow acting hardeners and quick acting hardeners as well as so called instant hardeners, which are particularly advantageous. Instant hardeners are compounds which effect cross-linking of suitable binders at such a rate that hardening is sufficiently completed immediately after casting or at the latest after 24 hours, preferably after not more than 8 hours, so that no further change in sensitometry or swelling of the combination of layers due to the cross-linking reaction can occur. The swelling is the difference between the wet layer thickness and the dry layer thickness of a film which is processed under aqueous conditions (Photographic Sci. Eng. 8 (1964), 275; Photographic Sci. Eng. (1972), 449).

These hardeners which react very rapidly with gelatine may be, for example, carbamoylpyridinium salts, which are capable of reacting with free carboxyl groups of gelatine so that the latter react with free amino groups of gelatine to form peptide bonds and effect cross-linking of the gelatine.

Compounds corresponding to the following general formulae are suitable examples of instant hardeners:

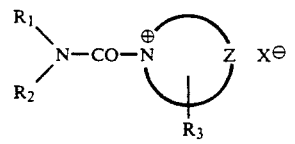

(a)

wherein $R_1$ denotes alkyl, aryl or aralkyl, $R_2$ has the same meaning as $R_1$ or denotes alkylene, arylene, aralkylene or alkaralkylene in which the second bond is linked with a group of the following formula:

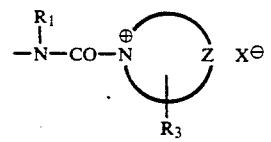

or $R_1$ and $R_2$ together denote the atoms required for completing an optionally substituted heterocyclic ring, for example a piperidine, piperazine or morpholine ring, which ring may be substituted, e.g. by $C_1$ to $C_3$ alkyl or by halogen, $R_3$ denotes hydrogen, alkyl, aryl, alkoxy, $—NR_4—COR_5$, $—(CH_2)_m—NR_8R_9$, $—(CH_2)_n—CONR_{13}R_{14}$ or

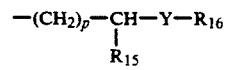

or a bridging member or a direct link to a polymer chain, and $R_4$, $R_6$, $R_7$, $R_9$, $R_{14}$, $R_{15}$, $R_{17}$, $R_{18}$ and $R_{19}$ denote hydrogen or $C_1$ to $C_4$ alkyl, $R_5$ denotes hydrogen, $C_1$ to $C_4$ alkyl or $NR_6R_7$, $R_8$ denotes $—COR_{10}$, $R_{10}$ denotes $NR_{11}R_{12}$, $R_{11}$ denotes $C_1$ to $C_4$ alkyl or aryl, in particular phenyl, $R_{12}$ denotes hydrogen, $C_1$ to $C_4$ alkyl or aryl, in particular phenyl, $R_{13}$ denotes hydrogen, $C_1$ to $C_4$ alkyl or aryl, in particular phenyl, $R_{16}$ denotes hydrogen, $C_1$ to $C_4$ alkyl, $COR_{18}$ or $CONHR_{19}$, m denotes a number from 1 to 3, n denotes a number from 0 to 3, p denotes a number from 2 to 3, and Y denotes O or $NR_{17}$ or $R_{13}$ and $R_{14}$ together denote the atoms required for completing an optionally substituted heterocyclic ring, for example a piperidine, piperazine or morpholine ring, which ring may be substituted, e.g. by $C_1$ to $C_3$ alkyl or by halogen, Z denotes the carbon atoms required for completing a 5 membered or 6 membered aromatic heterocyclic ring, optionally carrying a condensed benzene ring, and $X^{\ominus}$ denotes an anion, which is not present if an anionic group is already attached to the remainder of the molecule;

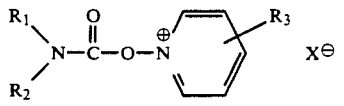

(b)

wherein $R_1$, $R_2$, $R_3$ and $X^{\ominus}$ have the meanings given for formula (a).

Some hardeners are diffusible and act equally on all the layers within a combination of layers. Other hardeners, which may be either low molecular weight or high molecular weight hardeners, are non-diffusible and limited in their action to a particular layer. These non-diffusible hardeners are capable of effecting a particularly high degree of cross-linking of individual layers, e.g. the protective layer. This is important when a silver halide layer is relatively soft on account of increasing the silver covering power so that the protective layer is required to improve the mechanical properties (EP-A 0 114 699).

Colour photographic negative materials are normally processed by development, bleaching, fixing and washing or by development, bleaching, fixing and stabilization without washing. Bleaching and fixing may be combined in a single processing step. The colour developer compounds used may be any developer compounds which in the form of their oxidation product are capable of reacting with colour couplers to form azomethine or indophenol dyes. Suitable colour developer compounds include aromatic compounds of the p-phenylene diamine series containing at least one primary amino group, for example: N,N-dialkyl-p-phenylene diamines such as N,N-diethyl-p-phenylene diamine, 1-(N-ethyl-N-methanesulphonamidoethyl)-3-methyl-p-phenylene diamine, 1-(N-ethyl-N-hydroxyethyl)-3-methyl-p-phenylene diamine and 1-(N-ethyl-N-methoxyethyl)-3-methyl-p-phenylene diamine. Other suitable colour developers are described, for example, in J. American Chem. Soc. 73, 3106 (1951) and G. Haist, Modern Photographic Processing, 1979, John Wiley and Sons, New York, pages 545 et seq.

Colour development may be followed by an acid short stop bath or by washing.

The material is normally bleached and fixed immediately after colour development. The bleaching agents used may be, for example, Fe(III) salts and Fe(III) complex salts such as ferricyanides, dichromates and water soluble cobalt complexes. Iron-(III) complexes of aminopolycarboxylic acids are especially preferred, in particular, for example, the complexes of ethylene diaminotetra-acetic acid, propylenediaminotetra-acetic acid, diethylenetriaminopenta-acetic acid, nitrilotriacetic acid, iminodiacetic acid, N-hydroxyethylethylenediamino-triacetic acid and alkyliminodicarboxylic acids and of corresponding phosphic acids. Persulphates and peroxides are also suitable bleaching agents, e.g hydrogen peroxide.

The bleach fixing bath or fixing bath is in most cases followed by washing which may be carried out as a counterflow washing or in several tanks each with its own water supply.

Advantageous results may be obtained by following this washing with a final bath containing little or no formaldehyde.

Washing may be replaced by a stabilizing bath, which is normally carried in countercurrent. When formaldehyde has been added, this stabilizing bath also takes over the function of a final bath.

Colour reversal materials are first developed with a black-white developer whose oxidation product is not capable of reacting with the colour couplers. This is followed by a diffuse second exposure which in turn is followed by development with a colour developer, bleaching and fixing.

EXAMPLE 1

Preparation of the Layers

The quantities of substance HK 5 according to the invention or of comparison substance V 1 indicated in Table 1 were added in each case to 1000 g of a sulphur and gold ripened, spectrally red sensitized silver iodobromide emulsion of tabular grains (average thickness 0.32 μm, average diameter of the tabular crystals 1.6 μm) containing silver halide in a quantity equivalent to 100 g or $AgNO_3$ per kg and 50 g of gelatine per kg.

A colour coupler emulsion containing 25 g of cyan coupler of the formula

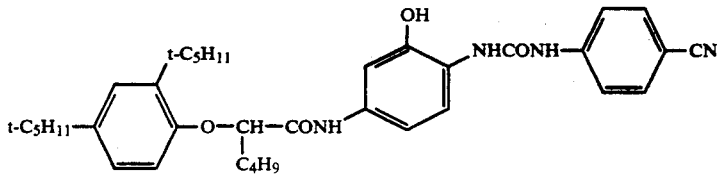

emulsified with 30 g of dibutyl phthalate and 20 g of gelatine was added to each of the emulsion samples, which all differed from one another.

The casting solutions thus obtained were cast on a transparent layer support (silver halide application: 3.0 $AgNO_3$ per $m^2$).

The layers were coated with a protective gelatine layer (dry layer thickness 0.5 μm) and hardened.

After imagewise exposure to red light with an exposure time of 1/100 sec behind a grey sensitometer wedge, the samples were processed by the colour negative process described in "the British Journal of Photography", 1974, pages 597 and 598.

The results (change in photographic sensitivity, colour graininess and fog) are entered in the accompanying tables. The gain in sensitivity by means of the compound according to the invention reaches a limiting value of +2.3 DIN at $5\times10^{-4}$ mol per 100 g of $AgNO_3$, the colour graininess remains unchanged within the limits of accuracy of measurement and the fog slightly decreases.

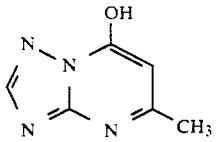

V1:

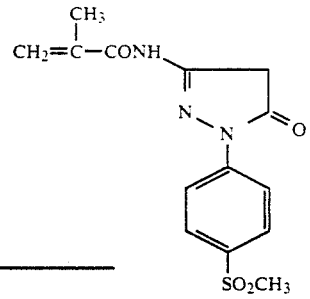

TABLE 1

| Sample No. | Substance Added | Quantity Added in $10^{-4}$ mol per 100 g of $AgNO_3$ | Sensitivity (DIN) | Graininess (RMS) at density 1.0 | Fog | |
|---|---|---|---|---|---|---|
| 1/0 | None | — | 27.5 | 26 | 0.17 | Comparison |
| 1/1 | HK 5 | 0.2 | 28.4 | 26 | 0.12 | Invention |
| 1/2 | HK 5 | 1 | 29.3 | 25 | 0.13 | Invention |
| 1/3 | HK 5 | 5 | 29.8 | 26 | 0.14 | Invention |
| 1/4 | V 1 | 0.2 | 27.6 | 25 | 0.16 | Comparison |
| 1/5 | V 1 | 1 | 27.5 | 26 | 0.16 | Comparison |
| 1/6 | V 1 | 5 | 27.6 | 26 | 0.16 | Comparison |

EXAMPLE 2

Preparation of the Layers

The quantities of substance HK 47 according to the invention or of comparison substance V 2 shown in Table 2 were added in each case to 1000 g of a sulphur and gold ripened, spectrally green sensitized silver iodobromide emulsion whose grains consisted of a core with a high iodide content (15 mol % $I^{\ominus}$) and a shell with a low iodide content (1 mol % $I^{\ominus}$) with an average total iodide content of 7 mol %, which emulsion contained a quantity of silver halide equivalent to 100 g of $AgNO_3$ per kg and 40 g of gelatine per kg.

90 g (solids content) of the magenta latex coupler composed of

50% of weight of butylacrylate,

20% by weight of monomer corresponding to the following formula

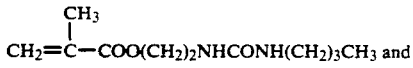

30% by weight of monomer corresponding to the following formula were added to the emulsion samples.

The resulting casting solutions were cast on a transparent layer support (silver halide application: 2·0 g per $m^2$).

The layers were coated with a protective gelatine layer (dry layer thickness 0·5 μm) and hardened.

After imagewise exposure to green light with an exposure time of 1/100 sec behind a grey sensitometer wedge, the samples were processed as in Example 1.

The results are entered in Table 2.

Table 2 shows that the sensitivity passes through a maximum at $0{\cdot}5\times10^{-4}$ mol per 100 g of $AgNO_3$ (Sample 2/1) while the graininess continuously decreases with increasing quantity of HK 47.

Although no sensitivity gain over comparison sample 2/0 is obtained at $1{\cdot}0\times10^{-4}$ mol per 100 g of $AgNO_3$ (Sample 2/2), a marked reduction in graininess is obtained. The sensitivity/graininess ratio is better in all the samples according to the invention than in comparison samples 2/4 to 2/6.

V 2:

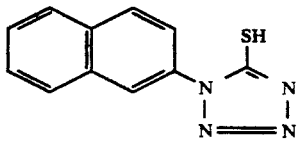

TABLE 2

| Sample No. | Substance Added | Quantity Added in $10^{-4}$ mol per 100 g of $AgNO_3$ | Sensitivity (DIN) | Graininess (RMS) at density 1.0 | Fog | |
|---|---|---|---|---|---|---|
| 2/0 | None | — | 24.3 | 38.0 | 0.04 | Comparison |
| 2/1 | HK 47 | 0.5 | 25.8 | 36.7 | 0.01 | Invention |
| 2/2 | HK 47 | 1.0 | 24.4 | 34.8 | 0.00 | Invention |
| 2/3 | HK 47 | 2.0 | 22.0 | 32.6 | 0.00 | Invention |
| 2/4 | V 2 | 0.5 | 23.4 | 36.5 | 0.01 | Comparison |
| 2/5 | V 2 | 1.0 | 21.2 | 35.0 | 0.00 | Comparison |
| 2/6 | V 2 | 2.0 | 18.8 | 32.5 | 0.00 | Comparison |

EXAMPLE 3

Three colour negative layer arrangements were prepared as follows:

3 A Arrangement containing additives according to the invention

3 B Comparison arrangement containing the corresponding comparison compounds

3 C Comparison arrangement without any of the above mentioned additives.

The following layers were applied in each case to a transparent layer support of cellulose triacetate in the sequence given here.

The quantities refer in each case to 1 $m^2$. The quantities of silver halide applied are given in terms of the corresponding quantities of $AgNO_3$.

All the silver halide emulsions were stabilized with 0·1 g of 4-hydroxy-6-methyl-tetraazaindene per 100 g of $AgNO_3$.

The quantities of substances added are listed in Table 3.

1st Layer (Antihalation Layer)

0·2 g of black colloidal silver
1·2 g of gelatine
0·1 g of UV absorbent

2nd Layer (Interlayer)

0·6 g of gelatine

3rd Layer (Low Sensitivity Red Sensitized Layer)

2.2 g of $AgNO_3$, Ag(Br,I) with 4 mol % iodide, average grain diameter 0.45 μm, red sensitized
2.0 g of gelatine
0.6 g of colourless cyan coupler as in Example 1 emulsified in 0.5 g of tricresyl phosphate (TCP
50 mg of coloured cyan coupler of the formula

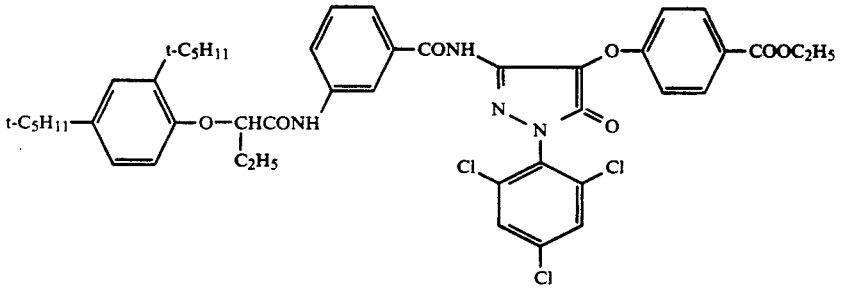

30 mg of DIR coupler of the formula

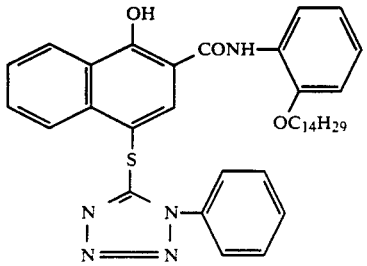

emulsified in 20 mg of TCP.

4th Layer (High Sensitivity Red Sensitized Layer)

2.8 g of $AgNO_3$, Ag (Br, I) with 8.5 mol % iodide, average grain diameter 0.8 μm, red sensitized
1.8 g of gelatine
0.15 g of colourless cyan coupler of the formula

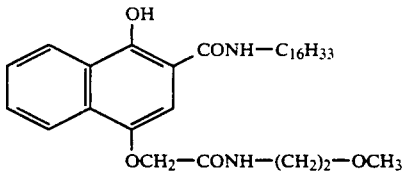

emulsified with 0.15 g of dibutyl phthalate (DBP)

5th Layer (Separating Layer)

0.7 g of gelatine
0.2 g of 2,5-diisooctyl hydroquinone emulsified with 0.15 g of DBP 6th Layer (Low Sensitivity Green Sensitized Layer)

1.8 g of $AgNO_3$ Ag(Br, I) with 4.5 mol % of iodide and having an average grain diameter of 0.4 μm, green sensitized,
1.6 g of gelatine
0.6 g of magenta coupler of the formula

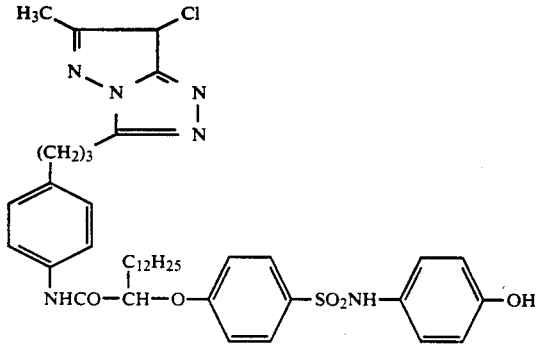

emulsified with 0.6 g of TCP
50 mg of masking coupler of the formula

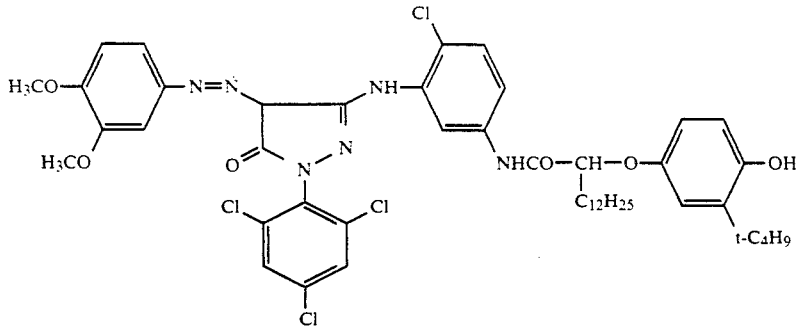

emulsified with 50 mg of TCP 30 mg of DIR coupler of the formula

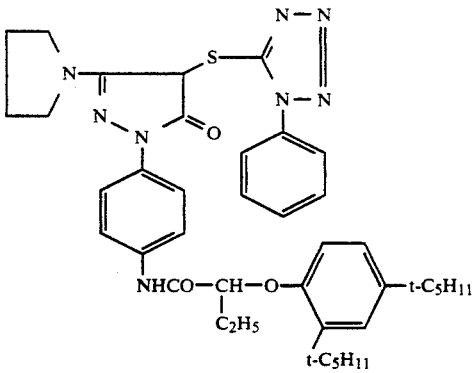

emulsified with 20 mg of DBP

7th Layer (High Sensitivity Green Sensitized Layer)

2.2 g of $AgNO_3$,Ag (Br,I) with 7 mol % of iodide and having an average grain diameter of 0.7 μm, green sensitized 1.4 g of gelatine 0.15 of magenta coupler of the formula

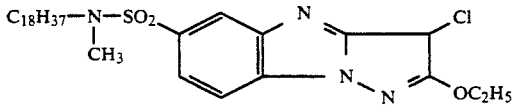

emulsified with 0.45 g of TCP 30 mg of masking coupler as in the 6th layer emulsified with 30 mg of TCP 8th Layer (Separating Layer)

0.5 g of gelatine 0.1 g of 2,5-diisooctyl hydroquinone emulsified with 0.08 g of DBP 9th Layer (Yellow Filter Layer)

0.2 g of Ag (yellow colloidal silver sol)

0.9 g of gelatine 0.2 g of 2,5-diisooctyl-hydroquinone emulsified with 0.16 of DBP 10th Layer (Low Sensitivity Blue Sensitive Layer)

0.6 g of $AgNO_3$, Ag (Br,I) with 4.9 mol % of iodide, average grain diameter 0.45 μm, blue sensitized 0.85 g of gelatine 0.7 g of yellow coupler of the formula

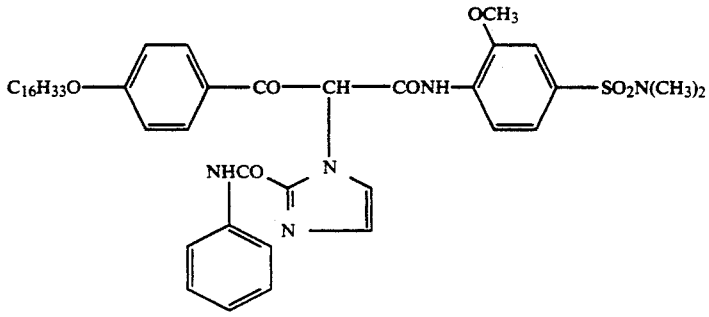

emulsified with 0.7 g of TCP 0.5 g of DIR coupler of the formula

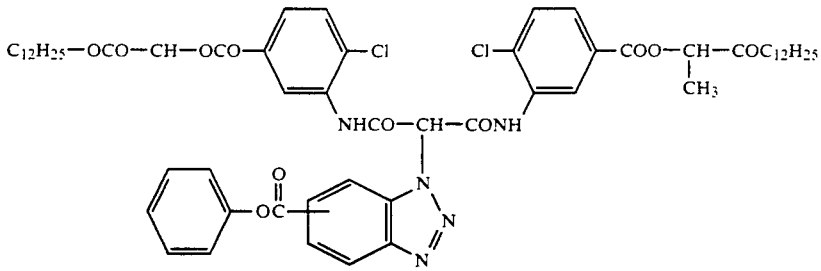

emulsified with 0.5 g of TCP

11th Layer (High Sensitivity Blue Sensitive Layer)

1·0 g of $AgNO_3$, 9·0 mol % iodide, average grain diameter 0·9 μm, blue sensitized 0·85 g of gelatine 0·3 g of yellow coupler as in 10th layer emulsified with 0·3 g of TCP 12th Layer 0·5 g of $AgNO_3$ of a micrate-Ag(Br, I) emulsion, average grain diameter 0·07 μm, 0·5 mol % iodide 1·2 of gelatine 0·4 g of hardener corresponding to the formula $(CH_2{=}CH{-}SO_2{-}CH_2{-}COHN{-}CH_2{-})_2{-}$ 1·g of formaldehyde acceptor corresponding to the following formula

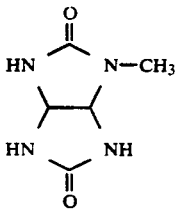

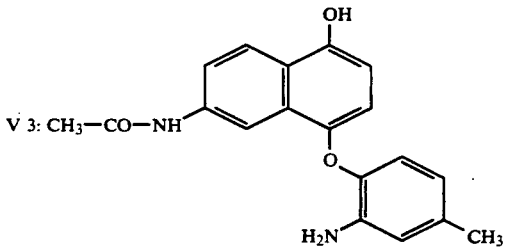

TABLE 3

| | Layer Arrangement 3A | | Layer Arrangement 3B | | Layer Arrangement 3C | |
|---|---|---|---|---|---|---|
| Layer | Type of Additive | Quantity Added in $10^{-4}$ mol per 100 g $AgNO_3$ | Type of Additive | Quantity Added in $10^{-4}$ mol per 100 g $AgNO^3$ | Type of Additive | Quantity Added |
| 3 | HK 47 | 3.5 | V 2 | 3.5 | — | — |
| 4 | HK 48 | 2.5 | V 3 | 2.5 | — | — |
| 6 | HK 47 | 2.8 | V 2 | 2.8 | — | — |
| 7 | HK 48 | 1.2 | V 3 | 1.3 | — | — |
| 10 | HK 47 | 1.5 | V 2 | 1.5 | — | — |
| 11 | HK 48 | 0.6 | V 3 | 0.6 | — | — |

After imagewise exposure to white light with an exposure time of 1/100 sec behind a grey sensitometer wedge, the samples were processed as in Example 1.

The results are entered in Table 4. This table shows the sensitivity gain obtained by means of the additives according to the invention. This sensitivity gain is greatest in the cyan layers (layers 3+4) situated closest to the layer support in the layer arrangement.

TABLE 4

| | | Layer Arrangement 3A | Layer Arrangement 3B | Layer Arrangement 3C |
|---|---|---|---|---|
| Yellow | Sensitivity (DIN) | 26.2 | 25.4 | 25.2 |
| | Graininess (RMS)* | 27 | 32 | 34 |
| Magenta | Sensitivity (DIN) | 26.5 | 25.0 | 24.8 |
| | Graininess (RMS)* | 10 | 14 | 15 |
| Cyan | Sensitivity (DIN) | 26.3 | 24.6 | 24.5 |
| | Graininess (RMS)* | 9 | 15 | 14 |

*RMS graininess determined at density 1.0 above fog

We claim:

1. Light sensitive color photographic silver halide material containing at least one red-sensitive silver halide emulsion layer with at least one non-diffusing cyan coupler, at least one green-sensitive silver halide emulsion layer with at least one non-diffusing magenta coupler and at least one blue-sensitive silver halide emulsion layer with at least one non-diffusing yellow coupler and optionally other light-insensitive layers, characterized in that one or more than one light-sensitive silver halide emulsion contains a compound corresponding to the following formula which has no diffusion inhibiting ballast residue $$A{-}(Z)_n{-}K \qquad (I)$$

at a concentration of $10^{-3}$ to 10 mmol/mol of silver halide, which compound of formula (I) is absorbed on and adheres to the silver halide grain and reacts with the developer oxidation product (EOP) with an effective reaction rate constant of $k_{eff} \geqq 10^3$ 1/mol.s, in which formula A denotes a grain active bonding group corresponding to formulae (IIa) to (IId):

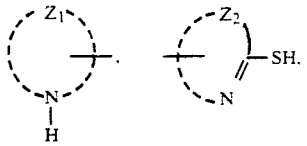

IIa IIb

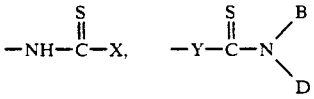

IIc IId $Z_1$ denotes the remaining members for completing a preferably 5 membered or 6 membered ring which contains at least one further heteroatom such as a nitrogen or sulphur atom and may be benzo or napththo condensed, $Z_2$ denotes the remaining members for completing a preferably 5 membered or 6 membered ring which is optionally benzo or naphtho condensed, X denotes $—NH_2$, —NHR,

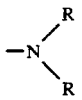

or SR,

Y denotes —S—, —NH— or —NR—,

B and D denote hydrogen or R or together represent the remaining members of a 5 or 6 membered ring, R denotes an aliphatic, aromatic or heterocyclic group, Z denotes a divalent intermediate member, n denotes 0 or 1 and K denotes a group which forms a colored or uncolored reaction product in the reaction with the developer oxidation product, the group $A—(Z)_n—$ being attached to K in a position other than the coupling position of K.

2. Light sensitive colour photographic silver halide material according to claim 1, characterised in that Z denotes an alkylene group, an arylene group, $—COCH_2$, $—COCH_2—S—$, $—COCH_2—O—$,

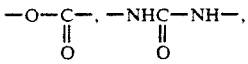

—CONH—, —S—, —O—, —O

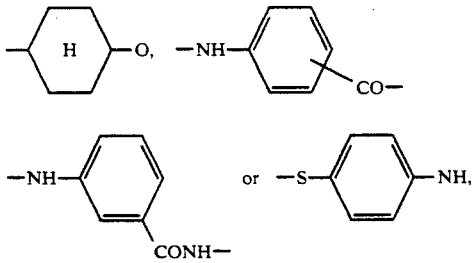

n is 1,

A denotes a grain active bonding group corresponding to the formula IIa, IIb, IIc or IId based on imidazole, benzotriazole, 1,2,3-triazole, 1,2,4-triazole, benzotriazole, tri-, tetra-, and pentazaindene, oxazole, thiazole, selenazole, oxadiozole, thiadiazole, tetrazole, pyridine or pyrimidine optionally substituted by alkyl, aryl, nitro, amino, hydroxy, carboxy, sulpho, halogen, cyano, alkylsulphonyl, alkylthio or arylthio and K denotes a yellow coupler of the β-ketocarboxylic acid series, a magenta coupler of the anilinopyrazolone series, the acylaminopyrazolone series, the cyanoacetophenone series, the pyrazoloazole series or the pyrazolobenzimidazole series or a cyan coupler of the phenol or naphthol series.

3. Light sensitive colour photographic silver halide material according to claim 1, characterised in that the compound of formula (I) is used in a quantity of from $10^{-2}$ to 1 mmol/mol of silver halide of the layer in which it is used.

* * * * *